United States Patent [19]

Suhr et al.

[11] 3,975,108

[45] Aug. 17, 1976

[54] SNOW PLOWABLE PAVEMENT MARKER

[75] Inventors: Donald C. Suhr, Farmington Hills, Mich.; John F. Domaracki; Robin A. Arnott, both of Windsor, Canada

[73] Assignee: ITL Industries, Inc., Newark, Ohio

[22] Filed: June 9, 1975

[21] Appl. No.: 585,002

[52] U.S. Cl. ..... 404/16

[51] Int. Cl.[2] ..... E01F 9/04

[58] Field of Search ..... 404/16, 14, 9, 10, 11; 350/103; 40/125 N

[56] References Cited

UNITED STATES PATENTS

| | | | |
|---|---|---|---|
| 1,910,791 | 5/1933 | Coppel | 404/16 |
| 2,126,224 | 8/1938 | Shaffer | 404/16 |
| 2,260,498 | 10/1941 | Wise | 404/16 |
| 2,708,858 | 5/1955 | DeShazor | 404/16 |
| 3,332,327 | 7/1967 | Heenan | 404/16 |
| 3,409,344 | 11/1968 | Balint | 404/14 X |
| 3,516,337 | 6/1970 | Gubela | 404/16 X |
| 3,587,416 | 6/1971 | Flanagan | 404/9 |
| 3,693,511 | 9/1972 | Medynski | 404/16 X |
| 3,758,191 | 9/1973 | Hedgewick | 404/16 X |

*Primary Examiner*—Nile C. Byers
*Attorney, Agent, or Firm*—Reising, Ethington, Barnard, Perry & Brooks

[57] ABSTRACT

A snow plowable pavement marker including a body having a base adapted to be secured to the surface of a roadway in such a manner that the fore and aft axis of the body extends parallel to the direction of travel of vehicles. A pair of snow plow ramp sections are secured to the body on opposite sides of the fore and aft axis thereof, the ramp sections including a pair of oppositely projecting snow plow ramps. The snow plow ramps each has an inner wall adjacent the fore and aft axis, an outer wall on the opposite side of the respective inner wall from the fore and aft axis, and a reinforcing rib extending along the length of the ramp between the respective inner and outer walls thereof. Each of the snow plow ramps has an enlarged end adjacent the pavement marker body, and decreases in cross-section to a relatively sharp tip portion at the distal end thereof spaced from the pavement marker body such that snow plows and like equipment will first contact the snow plow ramps at the tip portions and be guided over the pavement marker body by the snow plow ramps. Drain slots are formed in the edges of the inner walls, reinforcing ribs and outer walls of the snow plow ramps adjacent the plane of the base providing a passage for drainage of liquid from the space between the snow plow ramps. The snow plow ramps are made up primarily of plastic material, with the reinforcing rib, in one embodiment, being of metal interlocked with the plastic material.

26 Claims, 19 Drawing Figures

SNOW PLOWABLE PAVEMENT MARKER

BACKGROUND OF THE INVENTION

1. Field Of The Invention

This invention relates generally to pavement markers, and is particularly concerned with pavement markers constructed in such a way as to have high resistance to being damaged or displaced by snow plows and similar equipment.

2. Description Of The Prior Art

It has become common practice to delineate traffic lanes and the edges of roadways by pavement markers having retro-directive reflector elements or other reflecting material for reflecting the lights from vehicles traveling over the roadways at night. Such pavement markers are superior to painted strips on the roadways, since, under poor weather conditions, painted strips on the roadway are not visible.

A particular problem with pavement markers in colder climates is that the pavement markers are frequently subjected to damage and displacement by snow plows and similar road equipment. Typically, the pavement markers are secured to the surface of the roadway by an adhesive, such as an epoxy resin. If the pavement marker projects from the surface of the roadway at an abrupt angle, it is easily damaged or displaced when struck by a snow plow.

Several approaches have been taken in the prior art to provide resistance to damage by snow plows. One such approach is to mount the pavement marker in a recess in the roadway, and to resiliently support the pavement marker in the recess so that the pavement marker yields when engaged by a vehicle or the like. See, for example, U.S. Pat. Nos. 2,981,149 and 3,502,008. Another approach is to provide a heavy metal frame for the pavement marker. See, for example, U.S. Pat. Nos. 2,034,391; 1,849,419; 2,094,652; and 3,784,279.

Typical examples of reflective pavement markers are disclosed in U.S. Pat. Nos. 3,332,327; 3,409,344 and 3,516,337. The latter patents disclose pavement marker bodies having retro-directive reflector elements formed thereon, such as cube corner reflex reflector elements. In order to protect the cube corner reflector elements from moisture and chemical attack, the surface of the reflector elements are metallized. While the metallized layer performs the function of protecting the reflector elements, it also causes a loss of optical efficiency.

SUMMARY OF THE INVENTION

An object of the present invention is to provide a low-cost, lightweight, rugged pavement marker having snow plow ramps for guiding snow plows and similar equipment over the pavement marker in such a manner as to minimize the forces tending to damage or displace the pavement marker.

A further object is to provide a pavement marker having high resistance to damage and displacement by snow plows, and which utilizes a reflector member having retro-directive reflector elements wherein the reflector member is not directly subjected to the impact and shockloads imposed by vehicle wheels or snow plows.

A further object is to provide a snow plowable pavement marker having a body with a chamber formed therein and in which can be inserted either daytime or nighttime marker elements, or both, and hermetically sealed either before or upon installation on the surface of a roadway.

A still further object is to provide a rugged, yet relatively lightweight and inexpensive snow plow ramp that can be utilized with a variety of types of pavement markers to make it possible to utilize such pavement markers in cold climates.

In carrying out the foregoing, and other objects, a pavement marker according to the present invention includes a body having a base adapted to be secured to the surface of a roadway in such a manner that the fore and aft axis of the body extends parallel to the direction of travel of vehicles. The pavement marker includes a pair of ramp sections on opposite sides of the body, the ramp sections providing a pair of snow plow ramps projecting from the body and spaced from each other on opposite sides of the fore and aft axis of the body. Each of the ramps has an inner wall of plastic material adjacent the fore and aft axis, an outer wall of plastic material on the opposite side of its respective inner wall from the fore and aft axis, and a reinforcing rib extending along the length of the respective snow plow ramps between the inner and outer walls thereof. Each of the ramps decreases in cross-section from an enlarged end adjacent the body to a relatively sharp tip portion at the distal end thereof remote from the body.

Drain slots are preferably provided in the inner wall, reinforcing rib and outer wall of each of the snow plow ramps adjacent the plane of the base to provide a passage for draining the space between the snow plow ramps.

The snow plow ramps are preferably of plastic material and may be molded integrally with the pavement marker body. In one embodiment of the invention, the reinforcing ribs are of metal and are interlocked with the plastic material. In another embodiment, the reinforcing ribs are also of plastic material and are molded integrally with the snow plow ramp.

In the preferred embodiment, the ramp sections each have oppositely directed snow plow ramps so that the pavement marker has two pairs of snow plow ramps extending in opposite directions from each other, the snow plow ramps of each pair being located on opposite sides of the fore and aft axis.

The illustrated pavement marker body is shell-like and of dome-like configuration to form a chamber therein. The body is of transparent material to form a pair of oppositely extending transparent outer walls for the chamber so that the interior of the chamber is visible through the transparent outer walls. One or more markers are located in the chamber so as to be visible through the transparent walls thereof. A closure plate engages the peripheral edge portion of the body to close the chamber and, at least on installation, hermetically seal the chamber.

In order to prevent the accumulation of moisture within the hermetically sealed chamber, a desiccant, such as activated alumina, calcium chloride, silica gel, or zinc chloride may be provided in the chamber.

In the illustrated embodiments, the pavement marker body has a main rib that extends transversely of the fore and aft axis of the body (i.e., the axis that is parallel to the direction of travel when the pavement marker is installed on a roadway surface) and has a lower edge lying in the plane of the base and an upper edge integrally joined to the surface of the body within the chamber. The front and rear outer walls extend outwardly in opposite directions from the upper edge of the main rib and downwardly to the plane of the base. A pair of side walls spaced from each other on opposite sides of the fore and aft axis extend between the main rib and outer walls.

Other objects, advantages and features of the invention will become apparent from the following description taken in connection with the accompanying drawings.

DESCRIPTION OF THE PREFERRED EMBODIMENTS

Figure 1:
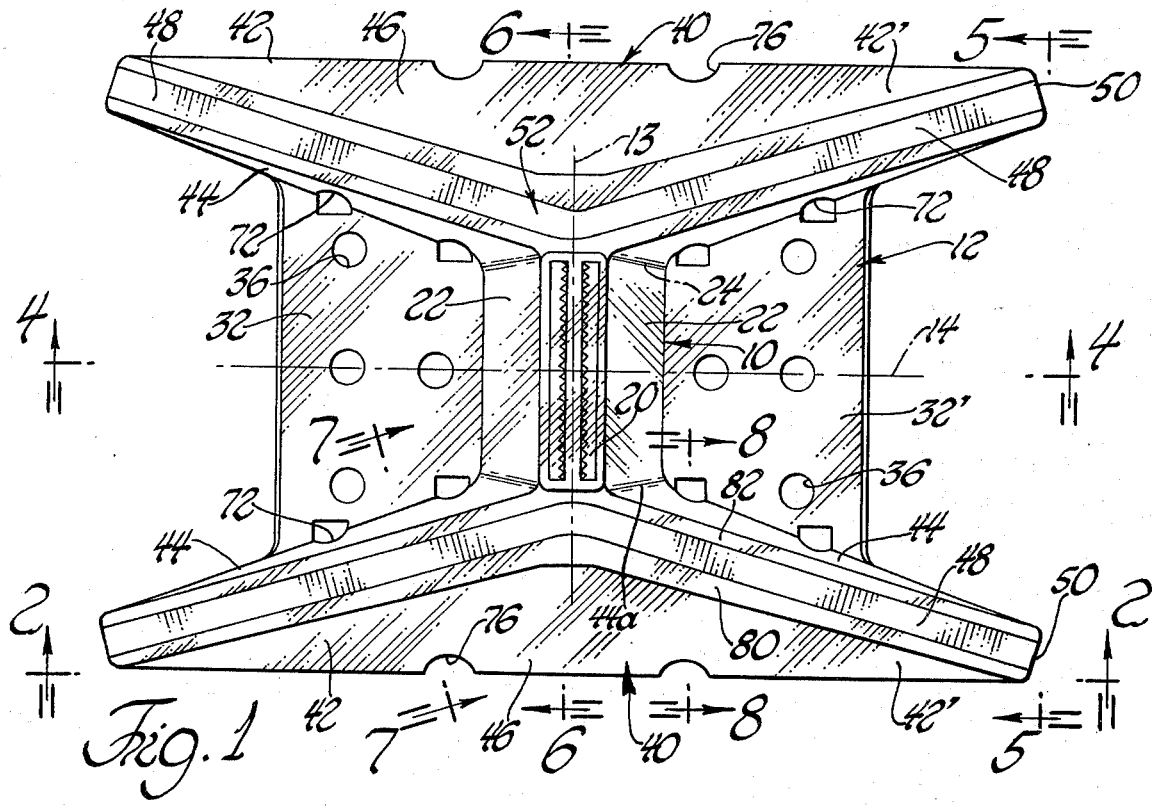
FIG. 1 is a top plan view of a pavement marker according to the present invention.

In the embodiment illustrated in FIGS. 1 through 9, reference numeral 10 collectively designates a shell-like pavement marker body having a base member 12 for engagement with the surface of a roadway. In FIG. 1, the fore and aft axis of the pavement marker is indicated by reference numeral 14, which fore and aft axis is the axis that extends parallel to the direction of vehicular travel when the pavement marker is installed on the surface of a roadway. Reference numeral 13 (FIG. 1) indicates a transverse axis that extends transversely to the direction of travel, the axes 13 and 14 intersecting each other at a right angle.

Figure 4:
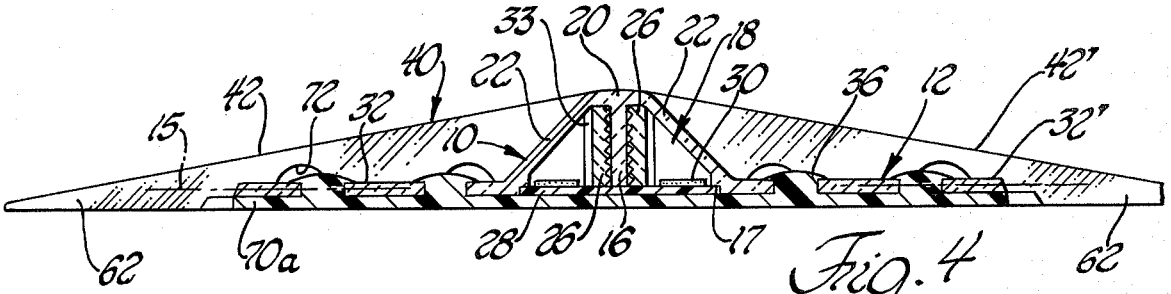
FIG. 4 is a sectional view taken on lines 4—4 of FIG. 1.
Figure 5:
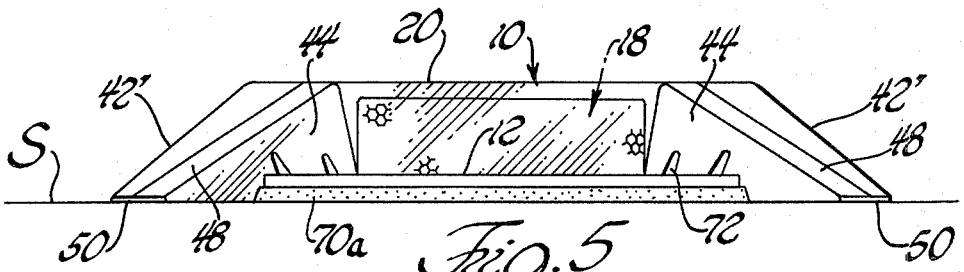
FIG. 5 is an end elevational view taken on lines 5—5 of FIG. 1.
Figure 6:
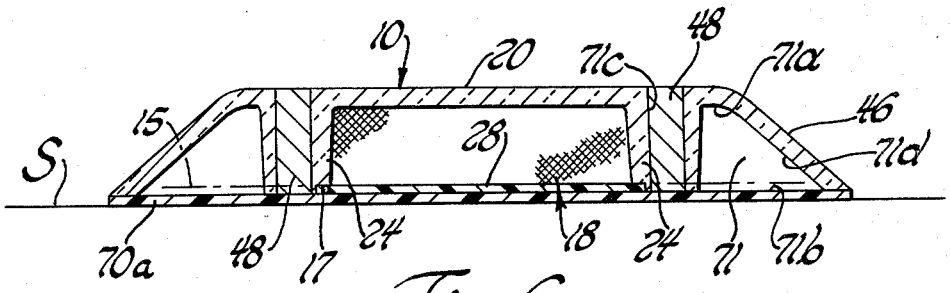
FIG. 6 is a sectional view taken on lines 6—6 of FIG. 1.

In FIGS. 4 and 6, reference numeral 15 indicates a base plane. The shell-like body 10 is open-ended and of dome-like configuration, and has an endless peripheral edge portion 17 lying in the base plane 15 and enclosing the open end of the body. The pavement marker body 10 projects from the base plane 15 to define a chamber 18 with its inner surface, the chamber 18 having an access opening enclosed by the endless peripheral edge portion 17. The base plane 15, as shown in FIGS. 4 and 6, is located approximately midway between the upper and lower surfaces of the base member 12.

The pavement marker body 10 is formed with an upright main rib 16 located in chamber 18 and extending transversely of the fore and aft axis 14, or parallel to the transverse axis 13. The main rib 16 has a lower edge lying in the base plane 15 and an upper edge integrally joined to the inner surface of the body 10 (FIG. 4). The upper edge of the main rib 16 is integrally joined to the inner surface of the top wall 20 of the pavement marker body 10, the rib 16 being joined to the top wall 20 approximately at the transverse axis 13, the top wall 20 projecting from the upper edge of the rib 16 on opposite sides of the transverse axis 13. A pair of outer walls 22 extend outwardly and downwardly from each of the edges of the top wall 20, the lower edges of the outer walls 22 being joined integrally to the base member 12, the walls 22 cooperating with the main rib 16 to form a pair of compartments within the chamber 18 on opposite sides of the main rib 16.

The pavement marker body 10 also includes a pair of spaced, parallel longitudinal ribs or side walls 24 (FIGS. 3 and 6) located at the opposite ends of the outer walls 22 and on opposite sides of the fore and aft axis 14. As shown in FIG. 6, the side walls 24 also have lower, free edges located in the base plane 15 defining a portion of the endless peripheral edge portion 17.

The pavement marker body 10 is of transparent material. The body 10 may be of glass or plastic, the plastic preferably being a synthetic resin material such as polycarbonate or acrylic. With the body 10 of transparent material, the interior of the chamber 18, as well as each of the compartments located on opposite sides of the main rib 16, are visible through the outer transparent walls 22.

Marker means is located in the chamber 18 so as to be visible through the transparent outer walls 22 of the pavement marker body 10. In the embodiment illustrated in FIGS. 1 through 9, the marker means includes a pair of nighttime marker elements 26 located in chamber 18 on opposite sides of the main rib 16. The nighttime marker elements 26 are operable to reflect light rays incident on the outer walls 22. Alternatively, daytime marker elements having opaque surfaces of any desired color visible through the outer walls 22 may be provided in one or both of the compartments located on opposite sides of the main rib 16.

The compartment 18 is closed by a closure plate 28 engaged with the peripheral edge 17 of the pavement marker body 10. The closure plate 28 may be secured to the pavement marker body 10 by sonic welding, for example, to hermetically seal the chamber 18, as well as the compartments in chamber 18 located on opposite sides of the main rib 16. Alternatively, the closure plate 28 may be detachably secured to the pavement marker body 10 so that the chamber 18 becomes hermetically sealed when the body 10, with the closure plate 28 detachably secured thereto, is seated in adhesive material on the surface of the roadway.

The illustrated nighttime marker elements 26 comprise reflector bodies, each of which has inner surfaces disposed in opposed relationship with the opposite surfaces of the main rib 16, which inner surfaces are formed with retro-directive reflector elements, such as cube corner reflex reflector elements. Although in the preferred embodiment, cube corner reflector elements are provided, other configurations of retro-directive reflector elements may be provided on the reflector bodies 26.

In order to prevent the accumulation of moisture within the chamber 18, sheets 30 of desiccant material, such as calcium chloride, are secured to the surface of the closure plate 28 within the chamber 18 as illustrated in FIG. 4. The sheets 30 of desiccant may be located in each of the compartments on opposite sides of the main rib 16, or in either of the compartments so long as there is atmospheric communication between the compartments. Locating projections 33 are formed on the side walls or longitudinal ribs 24 within the chamber 18 (FIG. 4) for engagement with the outer surfaces of the reflector members 26 at the ends thereof.

Figure 2:
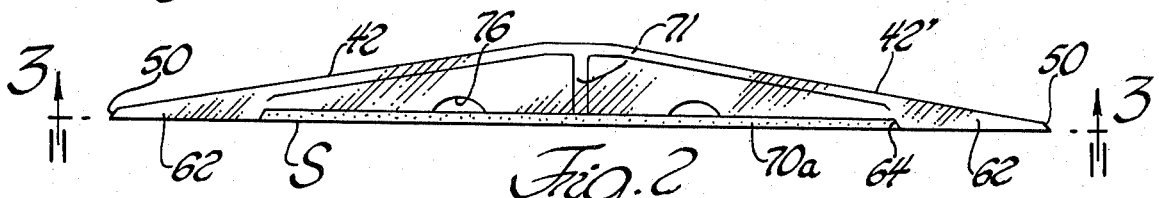
FIG. 2 is a side elevational view of the pavement marker of FIG. 1 as viewed along lines 2—2 of FIG. 1.
Figure 3:
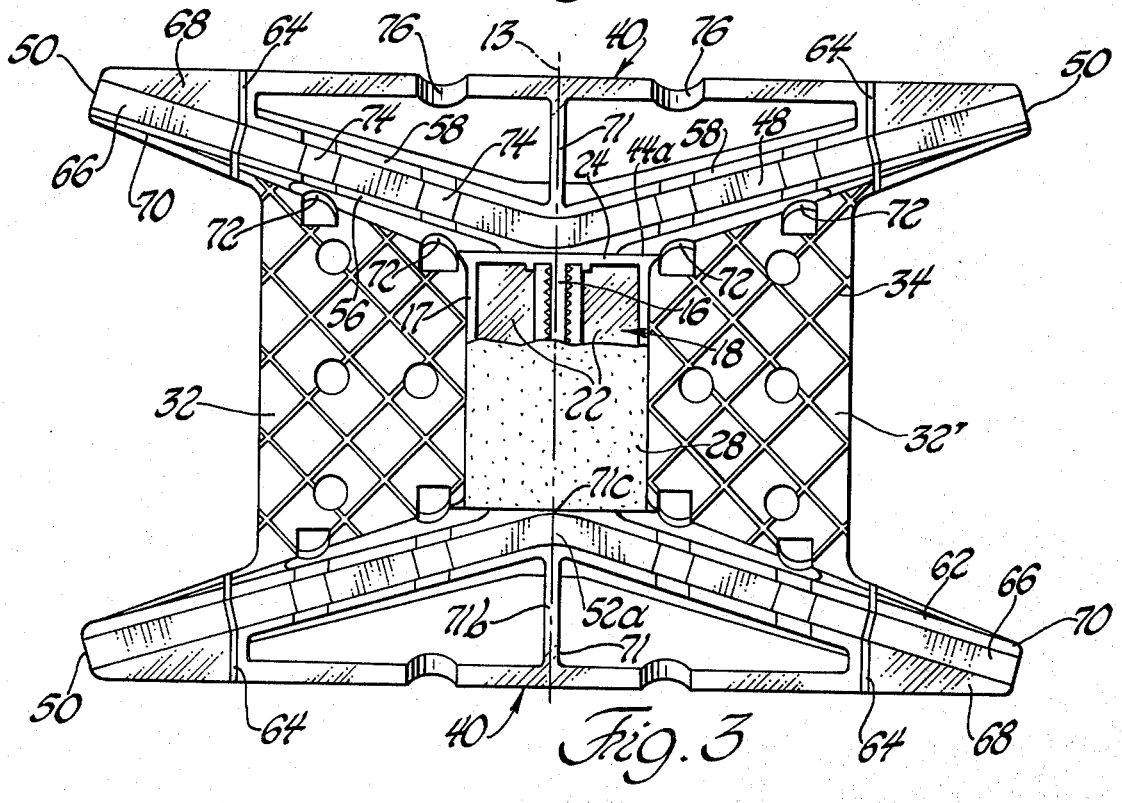
FIG. 3 is a bottom plan view taken on lines 3—3 of FIG. 2.

In the illustrated embodiment in FIGS. 1 through 9, the base member 12 is formed integral with the pavement marker body 10 and includes flanges 32 and 32' projecting in opposite directions from the lower ends of the resepective outer walls 22 of the pavement marker body 10. As shown in FIGS. 1 and 3, the base flanges 32 and 32' are of trapezoidal configuration.

A particular problem with pavement markers is that of maintaining the pavement marker in place on the roadway surface under the frequent shock loads imposed by the wheels of vehicles passing over the pavement marker. The shock loads imposed by the vehicle wheels frequently overcome the bond between the pavement marker and the adhesive material used to secure the pavement marker to the surface. In the embodiment of FIGS. 1–9, elongated ridges 34 project from the bottom surfaces of the base flanges 32 and 32' of the base member 12. As shown in FIG. 3, the ridges 34 are formed in a crisscross or diamond pattern.

A plurality of holes 36 (four in the illustrated embodiment) are formed in each of the flanges 32 and 32' of the base member 12. The holes 36 may be tapered, or countersunk, with the large end of each hole at the upper surface of the base member as disclosed, for example, in U.S. Pat. Nos. 3,096,694 and 3,758,191. The holes are filled with adhesive material, in the manner described below, to provide a mechanical interlock between the base member 12 and the adhesive material.

In accordance with the present invention, the pavement marker body 10 is made snow plow resistant by the provision of ramp sections 40 secured to opposite ends of the pavement marker body 10 at the side walls 24, and on opposite sides of the fore and aft axis 14. The ramp sections are designated collectively by reference numeral 40 in the drawings, and are identical to each other. Each ramp section 40 includes a pair of identical snow plow ramps 42 and 42' extending in opposite directions from the transverse axis 13; the ramp sections 40 are symmetrical about the transverse axis 13. The snow plow ramp 42' of one ramp section 40 projects from the body 10 in the same direction as the snow plow ramp 42' of the other ramp section 40. Hence, a pair of snow plow ramps 42 project in one direction from the transverse axis 13 of body 10 on opposite sides of the fore and aft axis 14, and a pair of snow plow ramps 42' project in the opposite direction from the transverse axis 13 of body 10 on opposite sides of the fore and aft axis 14.

Each of the snow plow ramps 42, 42' has an inner side wall 44 on the side thereof adjacent the fore and aft axis 14, an outer side wall 46 on the opposite side of its respective inner side wall 44 from the fore and aft axis 14, and a reinforcing rib 48 extending along the length thereof between the inner and outer side walls 44 and 46. Each of the snow plow ramps 42, 42' has an enlarged end adjacent the pavement marker body 10, and adjacent to the transverse axis 13, and decreases in cross-section to a relatively sharp tip portion at the distal end thereof spaced from the body 10 such that snow plows and like implements moving toward the body 10 from the tip portions 50 will be guided over the body 10 by the snow plow ramps 42, 42'.

Figure 7:
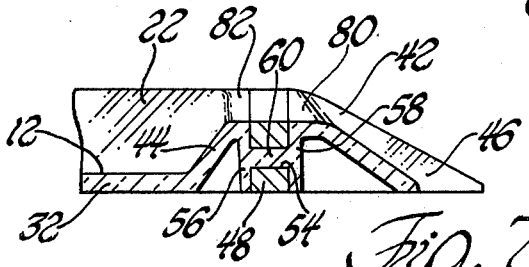
FIG. 7 is a sectional detailed view taken on lines 7—7 of FIG. 1.

The snow plow ramps 42, 42' in the embodiment of FIGS. 1–9 are of composite metal and plastic material, the plastic material being of synthetic resin such as polycarbonate. The reinforcing rib 48 is of metal, such as stainless steel, and is provided by a V-shaped reinforcing member 52 illustrated in elevational view in FIG. 9. The apex of the V-shaped reinforcing member 52 is located at the transverse axis 13 as illustrated in FIG. 1. The legs 48 of the reinforcing member 52 forming the ribs 48 of the oppositely extending snow plow ramps 42 and 42' extend outwardly from the apex at an obtuse angle (of approximately 150° in the illustrated embodiment) to the tip portions 50. Holes 54 are formed in the member 52, and, as illustrated in FIG. 7, provide a means for interlocking the reinforcing member 52 with the plastic material of the snow plow ramps. Depending from the upper surfaces of the ramps are a pair of spaced webs 56 and 58 (FIG. 7), the rib 48 being received between the spaced vertical webs 56 and 58. A connecting portion 60 of plastic material fills the opening 54 and has its opposite ends integrally joined to the webs 56 and 58. Hence, the metal reinforcing member 52 is molded integrally with the plastic material of the ramp sections to provide a composite plastic metal snow plow ramp. The reinforcing member 52 is preferably of stainless steel to provide high resistance to corrosion, as well as to provide high strength necessary to withstand the forces imposed by snow plows and the like.

Extending from the tip portion 50 of each of the snow plow ramps 42 and 42' is a foot portion 62 which projects below the bottom surface of the base flanges 32 and 32', the foot portion 62 extending between the tip portion 50 and a shoulder 64 as illustrated in FIGS. 2 and 3. The foot portion 62 is formed by a portion 66 at the ends of the rib portions 48 of member 52, which portion 66 is received between solid plastic portions 68 and 70 (FIG. 3). The bottom surface of the foot portion 62 engages the surface S of the roadway, and the height of the shoulder 64 above the surface S determines the thickness of the adhesive material 70a between the roadway surface S and the base member 12. As shown in FIG. 4, the holes 36 in the base flanges 32 and 32' are filled with the adhesive material 70a to provide a mechanical interlock between the base member 12 and the adhesive material.

The webs 58 depending from the top portions of the respective ribs 42 and 42' for each of the ramp sections 40 meet at the apex portion of member 52, or at the transverse axis 13 as shown in FIG. 3. A transverse reinforcing rib 71 extends between the outer wall 46 and the webs 58 along the transverse axis 13 as shown particularly in FIG. 3. Similarly, the corresponding webs 56 of ribs 42 and 42' of each ramp section meet at the apex portion of member 52, or at the transverse axis 13 as shown in FIG. 3.

Drain slots 72, 74 and 76 are formed respectively in the lower edges of the inner wall 44, the composite rib structure consisting of the metal rib 48 sandwiched between the webs 56 and 58, and the outer wall 76 to provide drain passages for draining liquid from the spaces between the cooperating pairs of snow plow ramps 42 and 42' on opposite sides of the fore and aft axis 14. Thus, the chamber 18 within the body 10 is hermetically sealed and isolated from the ramp sections 40, the ramp sections 40 being of hollow construction and provided with the drain slots or notches 72, 74 and 76. Consequently, melting snow and ice that accumulates between the ramps 42', and between the ramps 42, can drain into the hollow ramp sections 40 through the notches 72, and from the ramp sections 40 through the notches 74 and 76.

Figure 8:
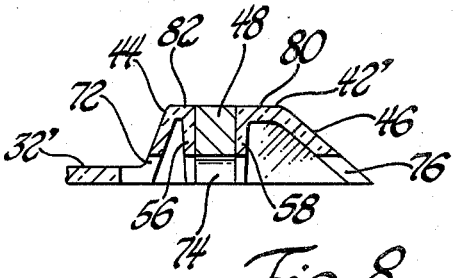
FIG. 8 is a sectional detailed view taken on lines 8—8 of FIG. 1.
Figure 9:
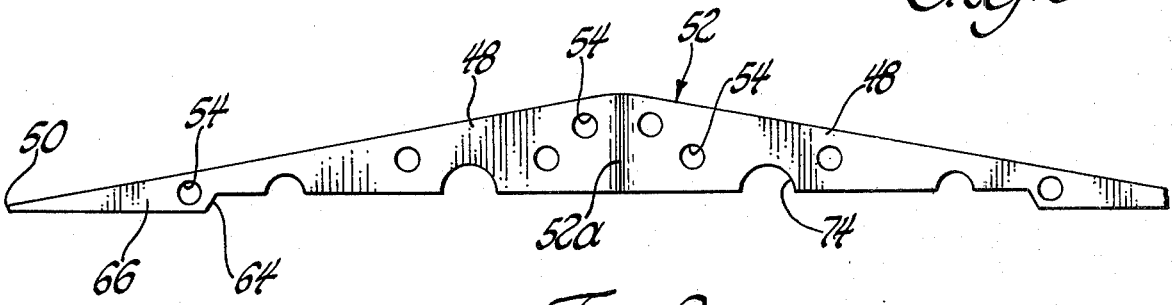
FIG. 9 is an elevational view of a reinforcing rib incorporated in the pavement marker of FIG. 1.
Figure 10:
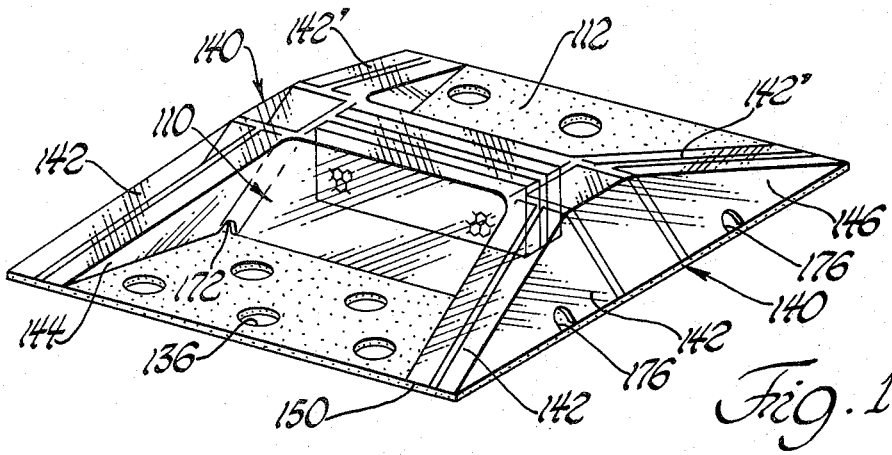
FIG. 10 is a perspective view of a second embodiment of the pavement marker according to the present invention.

As shown in FIGS. 7 and 8, the upper edge of the outer wall 46 is joined integrally to the outer edge of a top wall portion 80 formed integrally with the web 58, and the upper edge of the inner wall 44 is joined integrally to the edge of a top wall portion 82 formed integrally with the web 56. Consequently, the top wall of each of the snow plow ramps 42, 42' is defined by the surfaces 82, 80 and the top surface of the rib 48.

The top surfaces 80, 82 of associated snow plow ramps 42 and 42' are joined together at their inner ends remote from the tip portions 50 at the transverse axis 13 and the apex portion of member 52 (FIG. 1). The inner side walls 44 of associated snow plow ramps 42 and 42', as shown in FIG. 3, are joined to the side walls 24 of the pavement marker body 10.

Figure 11:
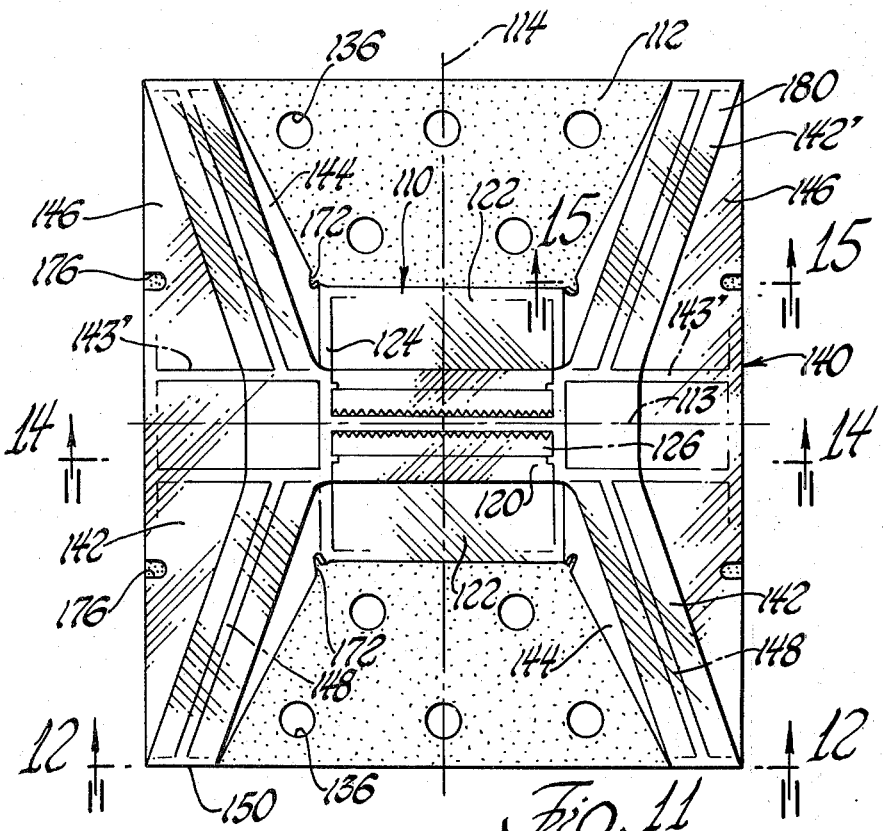
FIG. 11 is a top plan view of the pavement marker of FIG. 10.
Figure 12:
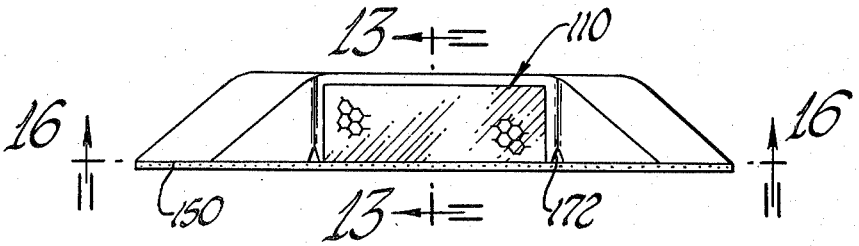
FIG. 12 is an end elevational view taken on lines 12—12 of FIG. 11.

In the embodiment illustrated in FIGS. 10 through 16, reference numeral 110 collectively designates a shell-like pavement marker body having a base member 112 for engagement with the surface of a roadway. In FIG. 11, the fore and aft axis of the pavement marker is indicated by reference numeral 114, which fore and aft axis is the axis that extends parallel to the direction of vehicular travel when the pavement marker is installed on the surface of a roadway. Reference numeral 113 (FIG. 11) indicates a transverse axis that extends transversely to the direction of travel, the axes 113 and 114 intersecting each other at a right angle.

In the embodiment of FIGS. 10–16, the base member 112 is rectangular with its peripheral edges defining the outer periphery of the pavement marker unit, including the body 110 and snow plow ramps. The upper surface of base member 112 lies in a plane. The shell-like body 110 is open-ended of dome-like configuration, and has an endless peripheral edge portion 117 lying in the plane of the upper surface of the base member 112 and enclosing the open end of the body 110. The pavement marker body 110 projects from the base plane to define a chamber 118 with its inner surface, the chamber 118 having an access opening enclosed by the endless peripheral edge portion 117.

Figure 13:
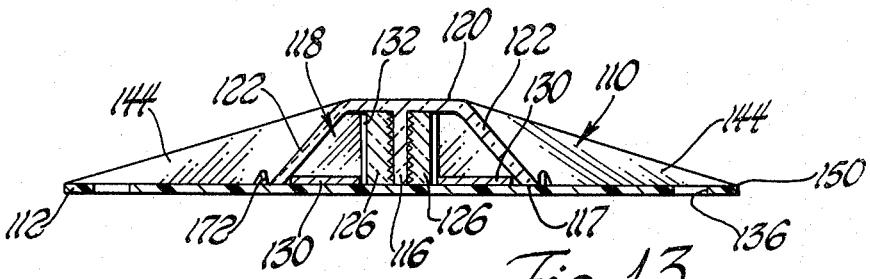
FIG. 13 is a sectional view taken on lines 13—13 of FIG. 12.

The pavement marker body 110 is formed with an upright main rib 116 located in chamber 118 and extending transversely of the fore and aft axis 114, or parallel to the transverse axis 113. The main rib 116 has a lower edge lying in the plane of base member 112, as is the case with the peripheral edge portion 117, and an upper edge integrally joined to the inner surface of the body 110 (FIG. 13). The upper edge of the main rib 116 is integrally joined to the inner surface of the top wall 120 of the pavement marker body 110, the rib 116 being joined to the top wall 120 approximately at the transverse axis 113, the top wall 120 projecting from the upper edge of the rib 116 on opposite sides of the transverse axis 113. A pair of outer walls 122 extend outwardly and downwardly from each of the edges of the top wall 120, the lower edges of the outer walls 122 being secured to the upper surface of the base member 112, the walls 122 cooperating with the main rib 116 to form a pair of compartments within the chamber 118 on opposite sides of the main rib 116.

Figure 14:
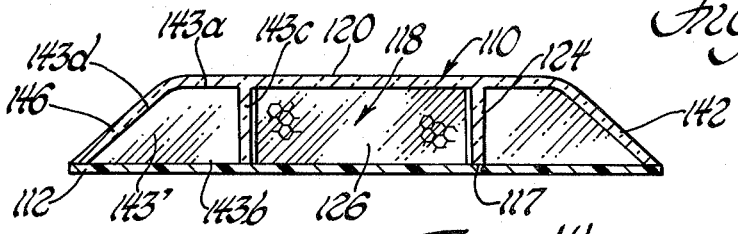
FIG. 14 is a sectional view taken on lines 14—14 of FIG. 11.

The pavement marker body 110 also includes a pair of spaced parallel longitudinal ribs or side walls 124 (FIGS. 14 and 16) located at the opposite ends of the outer walls 122 and on opposite sides of the fore and aft axis 114. As shown in FIG. 14, the side walls 24 also have lower, free edges which are located in the plane of the upper surface of base member 112 and which define a portion of the endless peripheral edge portion 117.

The pavement marker body 110 is of transparent material. The body 10 may be of glass or plastic, the plastic preferably being a synthetic resin material such as polycarbonate or acrylic. With the body 110 of transparent material, the interior of the chamber 118, as well as each of the compartments located on opposite sides of the main rib 116, are visible through the outer transparent walls 122.

Marker means is located in the chamber 118 so as to be visible through the transparent outer walls 122 of the pavement marker body 110. In the embodiment illustrated in FIGS. 10 through 16, the marker means includes a pair of nighttime marker elements 126 located in chamber 118 on opposite sides of the main rib 116. The nighttime marker elements 126 are operable to reflect light rays incident on the outer walls 122. Alternatively, daytime marker elements having opaque surfaces visible through the outer walls 122 may be provided in one or both of the compartments located on opposite sides of the main rib 116.

The compartment 118 is closed by the base member 112, the base member 112 defining a closure plate for body 110 engaged with the peripheral edge 117 of the pavement marker body 110. The base member 112 may be secured to the pavement marker body 110 by sonic welding, for example, to hermetically seal the chamber 118, as well as the compartments in chamber 118 located on opposite sides of the main rib 116.

The illustrated nighttime marker elements 126 comprise reflector bodies, each of which has inner surfaces disposed in opposed relationship with the opposite surfaces of the main rib 116, which inner surfaces are formed with retro-directive reflector elements, such as cube corner reflex reflector elements. Although in the preferred embodiment, cube corner reflector elements are provided, other configurations of retro-directive reflector elements may be provided on the reflector bodies 126.

In order to prevent the accumulation of moisture within the chamber 118, sheets 130 of desiccant material, such as calcium chloride, are secured to the surface of the closure plate defined by base member 112 within the chamber 118 as illustrated in FIG. 13. The sheets 130 of desiccant may be located in each of the compartments on opposite sides of the main rib 116, or in either of the compartments so long as there is atmospheric communication between the compartments. Locating projections 132 are formed on the side walls or longitudinal ribs 124 within the chamber 118 (FIGS. 13 and 14) for engagement with the outer surfaces of the reflector members 126 at the ends thereof.

As in the previously described embodiment, a plurality of holes 136 are formed in the base member 112, five such holes being shown on opposite sides of the body 110, or transverse axis 113. The holes 136 also may be tapered, or countersunk with the large end of each hole at the upper surface of the base member 112 as previously described in connection with FIGS. 1–9.

The pavement marker body 110 is made snow plow resistant by the provision of ramp sections 140 secured to opposite ends of the pavement marker body 110 at the side walls 124, and on opposite sides of the fore and aft axis 114. The ramp sections are each designated collectively by reference numeral 140 in the drawings, and are identical to each other. Each ramp section 140 includes a pair of identical snow plow ramps 142 and 142' extending in opposite directions from the transverse axis 113. The snow plow ramp 142' of one ramp section 140 projects from the body 110 in the same direction as the snow plow ramp 142' of the other ramp section 140. Hence, a pair of snow plow ramps 142 project in one direction from the transverse axis 113 of body 10 on opposite sides of the fore and aft axis 114, and a pair of snow plow ramps 142' project in the opposite direction from the transverse axis 113 of body 110 on opposite sides of the fore and aft axis 114.

Each of the snow plow ramps 142, 142' has an inner side wall 144 adjacent the fore and aft axis 114, an outer side wall 146 on the opposite side of its respective inner side wall 144 from the fore and aft axis 114, and a reinforcing rib 148 extending along the length thereof between the inner and outer side walls 144 and 146. Each of the snow plow ramps 142, 142' has an enlarged end adjacent the pavement marker body 110 defined by transverse ribs 143, 143' (FIG. 16) and adjacent to the transverse axis 113, and decreases in cross-section to a relatively sharp tip portion 150 at the distal end thereof spaced from the body 110 such that snow plows and like implements moving toward the body 10 from the top portions 150 will be guided over the body 110 by the snow plow ramps 142, 142'.

The snow plow ramps 142, 142' in the embodiment of FIGS. 10–16 are of plastic material, the plastic material being of synthetic resin such a polycarbonate. The reinforcing rib 48 is also of plastic material with the upper edges thereof joined integrally to the upper surface of the respective ramps 142, 142'.

Drains slots 172, 174 and 176 are formed respectively in the lower edges of the walls 144, reinforcing rib 148, and the outer wall 146 to provide drain passages for draining liquid from the spaces between the cooperating pairs of snow plow ramps 142 and 142' on opposite sides of the fore and aft axis 14. As in the previously described embodiment of FIGS. 1–9, the chamber 118 within the body 110 is hermetically sealed and isolated from the interiors of the ramps sections 140 the ramp sections 140 being of hollow construction and provided with the drain slots or notches 72, 74 and 76. Consequently, melting snow and ice that accumulates between the adjacent pairs of snow plow ramps 142' and 142 on the base member 112 can drain into the hollow ramp sections 140 through the notches 172, and from the hollow interior of the ramp sections 140 though the notches 174 and 176.

Figure 15:
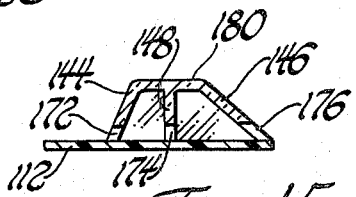
FIG. 15 is a sectional detailed view taken on lines 15—15 of FIG. 11.
Figure 16:
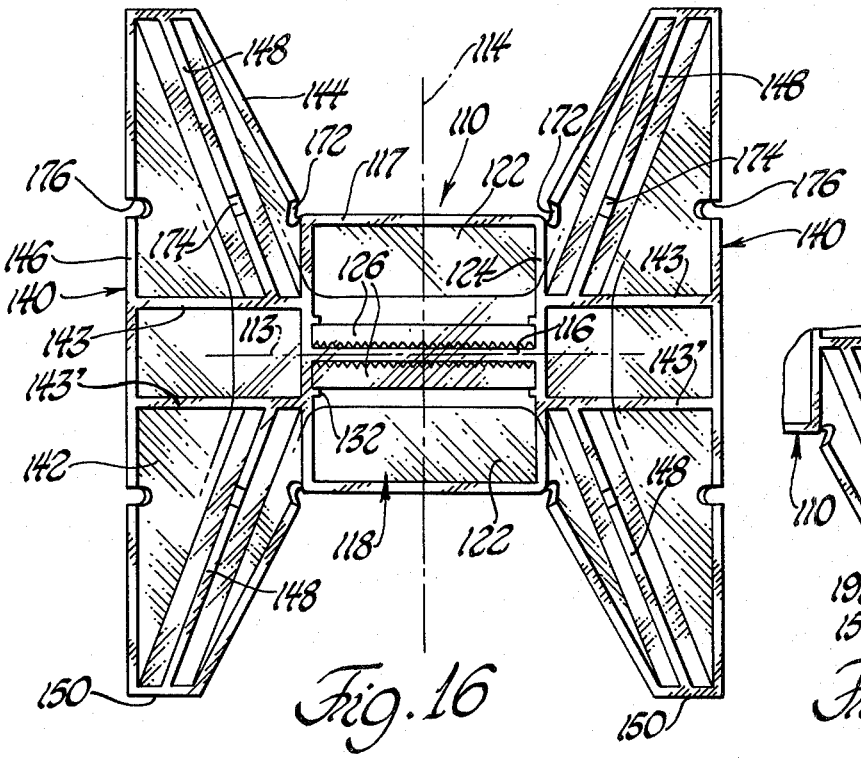
FIG. 16 is a bottom plan view taken on lines 16—16 of FIG. 12 with the base member removed to expose the interior of the pavement marker.

As shown particularly in FIG. 15, the outer wall 146 has its lower edge secured adhesively, by sonic welding, or other conventional means to the upper surface of the base member 112, and its upper edge joined integrally to the outer edge of a top wall 180 of each snow plow ramp. The reinforcing rib 148 has its upper end joined integrally to the lower surface of the top wall 180, and the inner wall 144 has its upper edge joined integrally to the edge of the top wall 180 opposite the edge to which the outer wall 146 is joined. The lower edge of the inner wall 144 is secured adhesively, by sonic welding, or other conventional means to the upper surface of the base member 112.

In the embodiment of FIGS. 10–16, the base member 112 is sealingly secured by sonic welding or the like to the peripheral edge portion 117 of the body 110 to hermetically seal the chamber 118. In the embodiment of FIGS. 10–16, the closure plate for the chamber 118 is thus an integral part of the base member 112 although a separate closure plate could obviously be provided. The base member 112 may also be formed with ridges corresponding to the ridges 34 formed on the bottom surface of the base member 112 of the embodiment of FIGS. 1–9.

Figure 17:
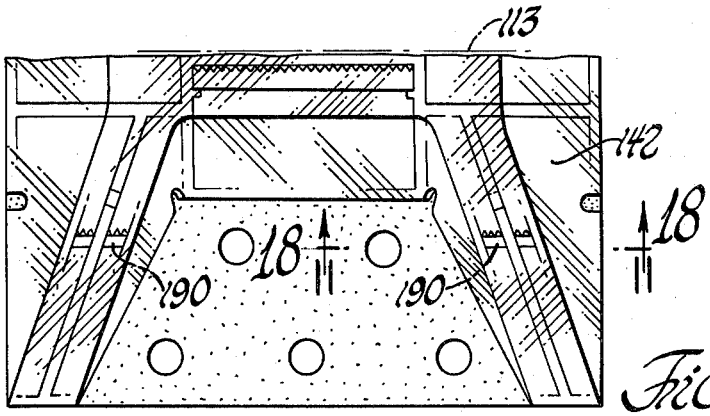
FIG. 17 is a partial top plan view of a modified version of the pavement marker of FIGS. 10–16.
Figure 18:
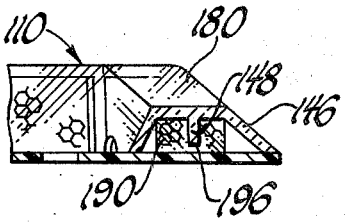
FIG. 18 is a sectional detailed view taken on lines 18—18 of FIG. 17.

FIGS. 17 and 18 illustrate a modification of the embodiment of FIGS. 10–16 wherein reflective bodies 190 are provided in the snow plow ramps 142. The reflector bodies 190 are provided with a central slot that receives the rib 148 (FIG. 18), the rib 148 being provided with a slot 192 at its lower edge for receiving the reflector body 190. The reflector body 190, in the illustrated embodiment, is provided with retro-directive reflector elements, preferably of the cube corner type for reflecting light rays incident on the reflector body 190 through the transparent walls of the snow plow ramps. In order to prevent loss of optical efficiency due to the accumulation of moisture, the rear surfaces of the reflector bodies 190, that is, the surfaces nearest the transverse axis 113 on which the retro-directive reflector elements are formed, may be metallized in a well known manner. Alternatively, the portion of the snow plow ramp in which the reflector bodies 190 are received may also be hermetically sealed and provided with desiccant material as is the case with the chamber 118.

Figure 19:
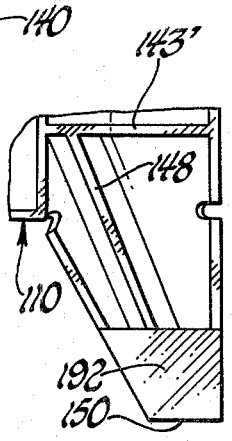
FIG. 19 is a partial bottom plan view illustrating a modified version of the pavement marker of FIG. 16.

FIG. 19 discloses still another modification of the embodiment of FIGS. 10–16 wherein a solid foot portion 192 is provided at the tip portion 150, the foot portion being formed of solid plastic material from the tip portion 150 for a selected distance toward the body 110 to provide high impact resistance to snow plows and similar equipment. After the initial impact, the snow plow slides along the upper surface of the snow plow ramps and is guided over the pavement marker body 110 by the snow plow ramps. The foot portion 192 may also project beneath the lower surface of the base member 112 as is the case with the foot portion 62 in the embodiment of FIGS. 1–9 to control the thickness of the adhesive material required to secure the unit to the surface of the pavement. The foot portions 192 may project forwardly from the edges of the base member 112 as is the case with the foot portions 62 in the embodiment of FIGS. 1–9, As pointed out previously, although the snow plow ramps are shown as used in connection with a particular type of pavement marker body, the snow plow ramps of the present invention may also be joined to the pavement marker bodies having a construction other than that of either the pavement marker body 10 or 110. Thus, in the embodiments of FIGS. 1–9, the snow plow ramps 42 or 42' may be considered to include a planar end portion at the transverse axis 13 consisting of the rib 71 (FIGS. 3 and 6) together with the apex portion 52*a* of the reinforcing member 52, the apex portion being the junction between the legs or ribs 48 of the reinforcing member 52. Hence, the snow plow ramps 42 or 42' include a planar end portion (FIGS. 3 and 6) having an upper edge 71*a*, a lower edge 71*b* an inner side edge 71*c* and outer side edge 71*d*. The inner side wall member 44 has an inner end 44*a* at its juncture with the body 10 (FIGS. 1 and 3) that is spaced slightly from the planar end portion, but extends generally from the inner edge 71*c* of the planar end portion, and the outer side wall member 46 extends from the outer edge 71*d* of the end wall member 71, the composite reinforcing rib 48, 56, 58 extending from the planar end portion intermediate the inner and outer edges 71*c* and *d* thereof and is received between the inner and outer side walls 44 and 46. The top wall surface consisting of surfaces 80, 82 and the top surface of rib 48 (FIG. 8) extends from the upper edge 71*a* of the planar end portion and between the upper edges of the inner and outer side wall members 44 and 46 with the reinforcing rib being joined to the top surface. The inner side wall 44, outer side wall 46, reinforcing rib 48 and top surface extend from the end portion at the transverse axis 13 to a distal end of the snow plow ramp 42, 42' spaced from the end portion at axis 13. The snow plow ramp 42, 42' decreases in cross-section from the enlarged end defined at the end portion at axis 13 to a tip portion 50 at the distal end.

The inner and outer side wall members 44 and 46, respectively, converge toward each other as they extend from the transverse axis 13 toward the tip portion 50 at the distal end thereof. The inner side wall 44 extends at an acute angle with respect to the plane of axis 13, and the outer side wall member 46 extends from the outer edge 71*d* of the end portion at axis 13 substantially perpendicularly with respect to the transverse axis 13, on the enlarged end portion of the respective snow plow ramp. The reinforcing rib 48 extends from the end portion at axis 13 at an acute angle with respect to the plane of axis 13 and converges toward the outer side wall 46 as it extends from the plane of the transverse axis 13 to the distal end where the tip portion 50 is located.

Since the lower edge 71*b* of the end portion at axis 13 has a greater length than the upper edge 71*a* thereof, the inner and outer side wall members 44 and 46, respectively, are inclined upwardly and inwardly from their lower edges to the top surface defined by surfaces 80, 82 and the top surface of rib 48.

In the embodiment of FIGS. 10–16, the transverse ribs 143, 143' may be considered to define the end walls for the snow plow ramps 142, 142'. With reference to FIG. 14, the end wall 143' has an upper edge 143*a*, a lower edge 143*b*, an inner edge 143*c*, and an outer edge 143*d*. The inner side wall member 144 extends from the inner edge 143*c*, the outer side wall member 146 extends from the outer edge 143*d*, and the reinforcing rib 148 extends from the end wall member 143' intermediate the inner and outer edges 143*c* and *d* and is received between the inner and outer side walls 144 and 146, respectively. The top wall surface 180 extends from the upper edge 143*a* of the end wall member 143' and between the upper edges of the inner and outer side walls 144 and 146, respectively (FIG. 15). The inner and outer side walls 144 and 146, respectively, reinforcing rib 148, and top wall 180 extend from the end wall member 143' to a distal end of the snow plow ramp 142 or 142' spaced from the end wall member 143' where the tip portion 150 is located. The upper edge 143*a* of the end wall 143' has less length than the lower edge 143*b*, and the inner and outer side walls 144 and 146, respectively, are inclined upwardly and inwardly from their lower edges to the top wall 180 as shown, for example in FIG. 15.

The ramp section 40 including the V-shaped reinforcing member 52, inner side wall members 44, outer side wall member 46, rib 71, webs 56, 58, connectors 60 and other associated features can be manufactured separately from the pavement marker body and can be attached to a variety of types of pavement marker bodies to provide a snow plow protection therefor. Similarly, the ramp sections 140 including the inner side wall members 144, the outer side wall 146, transverse ribs 143, 143', reinforcing ribs 148 at the other associated structural features of the ramp sections 140 can also be manufactured separately and joined to a variety of types of pavement marker bodies to provide snow plow protection therefor.

The embodiments of FIGS. 10–19 may be designed such as to have a strength less than that necessary to withstand the forces of snow plows, but simply with sufficient strength to withstand the forces of vehicle wheels.

While several specific forms of the invention have been illustrated and described in the foregoing specification and accompanying drawings, the invention is not limited to the exact construction shown. To the contrary, alterations in the construction and arrangements of parts, all fall within the scope and spirit of the invention, will be apparent to those skilled in the art.

The embodiments of the invention in which an exclusive property or privilege is claimed are defined as follows:

1. A snow plowable pavement marker comprising: a body having a fore and aft axis that extends parallel to the direction of travel when the body is secured to the surface of a roadway; a pair of snow plow ramps projecting from said body on opposite sides of said fore and aft axis; each of said snow plow ramps having an inner side wall of plastic material adjacent said fore and aft axis, an outer side wall of plastic material spaced from said inner side wall and located on the opposite side thereof from said fore and aft axis, a top surface at least partially or plastic material extending between the upper edges of said inner and outer side walls, and at least one reinforcing rib extending along the length thereof between said inner and outer side walls with one edge integral with said top surface; each of said snow plow ramps having an enlarged end adjacent said body and decreasing in cross-section to a tip portion at the distal end thereof spaced from said body such that snow plows and like implements moving toward said body in the direction from said tip portions will be guided over said body by said snow plow ramps.

2. A pavement marker as claimed in claim 1 further including drain slots in the lower edges of said inner wall, reinforcing rib and outer wall providing a passage for draining the space between said ramps.

3. A pavement marker as claimed in claim 1 wherein said top surfaces are entirely of plastic material and said reinforcing ribs are of plastic material.

4. A pavement marker as claimed in claim 1 wherein said reinforcing ribs are of metal.

5. A pavement marker as claimed in claim 4 wherein said reinforcing ribs are each interlocked with the plastic material of the respective ramps.

6. A pavement marker as claimed in claim 5 further including: a pair of spaced webs of plastic material extending along the length of each of said ramps, the respective metal reinforcing rib being received between said webs, a plurality of openings formed in said respective rib, and a plastic connector extending through each of said openings and integrally joined at its opposite ends to said pair of webs to interlock said metal reinforcing rib with said webs.

7. A pavement marker as claimed in claim 6 wherein said body has a base adapted to be adhesively secured to the surface of a roadway, and wherein said ramps each has a toe portion at said distal end thereof having a ground engaging surface that projects beneath the lower surface of said base for locating the base with respect to the roadway surface and determining the depth of adhesive material for securing the base to such surface.

8. A pavement marker as claimed in claim 1 wherein each of said ramps has a solid toe portion at the distal end thereof.

9. A pavement marker as claimed in claim 1 wherein each of said ramps is of transparent material, and further including reflector means in each of said ramps visible through the transparent material for reflecting light rays incident on the respective ramps.

10. A pavement marker as claimed in claim 1 wherein said body is shell-like with a chamber formed therein; said body being at least partially of transparent material to form a transparent outer wall for said chamber so that the interior of said chamber is visible through said transparent outer wall; and further including marker means located in said chamber so as to be visible through said transparent outer wall.

11. A pavement marker as claimed in claim 10 wherein said body has a base adapted to be aadhesively secured to the surface of a roadway, and wherein said body has an endless peripheral edge portion lying substantially in the plane of said base; said body being of dome-like configuration projecting from the plane of said base to define said chamber at least in part with its inner surface.

12. A pavement marker as claimed in claim 11 wherein said chamber has an access opening surrounded by said peripheral edge portion, and a closure plate is secured to said body at the peripheral edge portion thereof to form a wall of said chamber.

13. A pavement marker as claimed in claim 2, wherein said closure plate is sealingly secured to said peripheral edge portion to hermetically seal said chamber.

14. A pavement marker as claimed in claim 3 further including desiccant material in said chamber to prevent the accumulation of moisture therein.

15. A pavement marker as claimed in claim 14 wherein said marker means includes at least one nighttime marker element operable to reflect light rays incident on said transparent outer wall.

16. A pavement marker as claimed in claim 15 wherein said base includes a base portion having a flange projecting outwardly from the peripheral edge portion of said body between said ramps.

17. A pavement marker as claimed in claim 16 further including a main rib in said chamber extending transversely of the fore and aft axis; said main rib having a lower edge lying in the plane of said base and engaged with said closure plate, and an upper edge spaced from said base plane and integrally joined to the inner surface of said body.

18. A pavement marker as claimed in claim 17 wherein said transparent outer wall extends outwardly from the upper edge of said main rib and downwardly to said base.

19. A pavement marker as claimed in claim 18 wherein said body includes a pair of side walls spaced from each other on opposite sides of said fore and aft axis and extending between said main rib and outer wall.

20. A snow plowable pavement marker comprising: a body adapted to be secured to the surface of roadway, said body having a fore and aft axis that extends parallel to the direction of travel when the body is secured to a roadway; a pair of snow plow ramp sections secured to opposite ends of said body on opposite sides of said fore and aft axis, each of said ramp sections including a pair of oppositely extending snow plow ramps, each of said snow plow ramps having an inner side wall of plastic material adjacent said fore and aft axis, an outer side wall of plastic material spaced from said inner side wall and located on the opposite side thereof from said fore and aft axis, a top surface at least partially of plastic material extending between the upper edges of said inner and outer integral walls and a reinforcing rib extending along the length thereof between said inner and outer side walls with one edge integral with said top surface; each of said snow plow ramps having an enlarged end adjacent said body and decreasing in cross-section to a tip portion at the distal end thereof spaced from said body such that snow plows and like implements moving toward said body will be guided over said body by said snow plow ramps.

21. A pavement marker as claimed in claim 20 further including drain slots in the lower edges of each of said inner side walls, reinforcing ribs, and outer side walls providing a drain passage for draining the space between adjacent pairs of the snow plow ramps.

22. A pavement marker as claimed in claim 20 further including a plurality of holes formed in said reinforcing member and each leg thereof, a pair of plastic webs integral with the respective snow plow ramps and located on opposite sides of the respective leg of said reinforcing member, and connectors extending through said openings each having its opposite ends joined integrally to said webs.

23. A snow plow ramp section adapted to be secured to a pavement marker body for guiding snow plows and like implements over the pavement marker body, said snow plow ramp section having a transverse axis intermediate the ends thereof that extends transversely to the direction of vehicular travel when the snow plow ramp is installed with a pavement marker body on the surface of a roadway, said snow plow ramp section comprising: a pair of snow plow ramps projecting in opposite directions from said transverse axis; each of said snow plow ramps having an enlarged end adjacent said transverse axis and decreasing in cross-section to a tip portion at the distal end thereof spaced from said transverse axis; said snow plow ramp section having an outer wall extending from one of said tip portions to the other, said outer wall having a straight lower edge; each of said snow plow ramps having an inner side wall extending from said tip portion toward said transverse axis and diverging from the straight lower edge of said outer side wall to the direction of said transverse axis; each of said snow plow ramps having a reinforcing rib extending from the respective tip portion toward said transverse axis and diverging from the straight lower edge of said outer side wall in the direction of said transverse axis; and each of said snow plow ramps having a top portion extending between the upper edges of said outer side wall and the respective inner side walls of said snow plow ramps.

24. A snow plow ramp section as claimed in claim 23 wherein the lower edges of said inner side walls, reinforcing ribs, and outer side walls lie substantially in the same plane, and further including drain slots in the lower edges of each of said inner side walls, each of said reinforcing ribs, and said outer side wall to permit liquid to flow into and out of said snow plow ramp section when said lower edges are supported on the surface of a roadway.

25. A snow plow ramp section as claimed in claim 23 wherein each of said reinforcing ribs is of metal and wherein said inner side walls, said top walls, and said outer side wall are of plastic material, and further including means for mechanically interlocking said metal reinforcing ribs with said top wall.

26. A snow plowable pavement marker comprising: a body having a fore and aft axis that extends parallel to the direction of travel when the body is secured to the surface of a roadway and a transverse axis extending perpendicularly with respace to said fore and aft axis; means defining a base plane for said body; said body having a top wall spaced from said base plane, a pair of outer walls extending in opposite directions from said top wall to said base plane with said fore and aft axis intersecting said outer walls, and a pair of side walls spaced from each other on opposite sides of said fore and aft axis and depending from said top wall and extending between said pair of outer walls; a pair of snow plow ramp sections each secured to one of said side walls; each of said snow plow ramp sections including a pair of snow plow ramps extending in opposite directions from said transverse axis; each of said snow plow ramps having an enlarged end adjacent said transverse axis and decreasing in cross-section to a tip portion at the distal end thereof spaced from said transverse axis such that snow plows and like implements moving toward said body in a direction from said tip portion will be guided over said body by said snow plow ramps; each of said snow plow ramp sections having an outer side wall extending from the tip portion of one of its snow plow ramps to the tip portion of the other of its snow plow ramps; said outer side wall having a straight lower edge; each of said snow plow ramps having an inner side wall extending from said tip portion toward said transverse axis and diverging from the straight lower edge of said outer side wall in the direction of said transverse axis; each of said snow plow ramp sections having a V-shaped metal reinforcing member with its apex located at said transverse axis and a pair of legs extending outwardly with respect to said body from said apex portion to said distal ends of said snow plow amps to define reinforcing ribs for said respective snow plow ramps to define reinforcing ribs for said respective snow plow ramps, said reinforcing ribs being received between the inner walls of said respective snow plow ramps and said outer wall of said ramp section; a top wall portion extending from the upper edge of each of said inner side wall to the respective leg of said reinforcing member; a top wall portion extending from the upper edge of said outer side wall to the reinforcing rib of each of said snow plow ramps; a web portion depending from each of said top wall portions on opposite sides of each of said reinforcing ribs; at least one hole in each of said reinforcing ribs; and a connector extending through each of said holes with its opposite end joined to the webs on opposite sides of said reinforcing rib to interlock said reinforcing rib with said webs; said ramp section being entirely of plastic material except for said V-shaped reinforcing member.

* * * * *